US007992728B2

(12) United States Patent
Burgess et al.

(10) Patent No.: US 7,992,728 B2
(45) Date of Patent: Aug. 9, 2011

(54) VERSATILE TRACK FOR STORAGE AND ORGANIZATION

(75) Inventors: Roddy Burgess, Charlotte, NC (US); Teren Branson, Charlotte, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 505 days.

(21) Appl. No.: 12/183,821

(22) Filed: Jul. 31, 2008

(65) Prior Publication Data

US 2010/0025348 A1 Feb. 4, 2010

(51) Int. Cl.
*A47F 3/14* (2006.01)

(52) U.S. Cl. ..... 211/94.01; 211/126.15

(58) Field of Classification Search ..... 211/85.28, 211/126.15, 94.01, 181.1, 85.29, 41.11, 88.01; 248/220.22, 225.11, 175, 205.1; 312/334.24, 312/334.27, 334.29, 334.31, 334.32, 245
See application file for complete search history.

(56) References Cited

U.S. PATENT DOCUMENTS

| | | | | | |
|---|---|---|---|---|---|
| 2,321,520 | A | * | 6/1943 | Ruckman | 312/334.29 |
| 2,857,233 | A | * | 10/1958 | Hahn et al. | 312/334.31 |
| 3,124,253 | A | | 3/1964 | Petrich | |
| 3,825,310 | A | * | 7/1974 | Roemer | 384/23 |
| 3,954,182 | A | * | 5/1976 | McEvers | 211/94.01 |
| 4,412,703 | A | | 11/1983 | Simonson | |
| 4,738,369 | A | * | 4/1988 | Desjardins | 211/113 |
| 4,805,783 | A | * | 2/1989 | Mayer | 211/94.01 |
| 4,869,378 | A | | 9/1989 | Miller | |
| 4,869,379 | A | * | 9/1989 | Hawkrige | 211/100 |
| 5,230,554 | A | * | 7/1993 | Camilleri | 312/334.6 |
| 5,429,252 | A | | 7/1995 | Liu | |
| 5,551,580 | A | | 9/1996 | Knutson | |
| 5,655,672 | A | | 8/1997 | Stuchlik, III | |
| 5,775,521 | A | | 7/1998 | Tisbo | |
| 5,960,967 | A | | 10/1999 | Neil | |
| 6,113,201 | A | * | 9/2000 | Bauer | 312/245 |
| 6,349,507 | B1 | * | 2/2002 | Muellerleile | 52/36.5 |
| 6,659,293 | B1 | * | 12/2003 | Smith | 211/59.2 |
| 6,679,392 | B1 | | 1/2004 | Costa | |
| 6,976,595 | B1 | | 12/2005 | Geller | |
| 7,832,568 | B2 | * | 11/2010 | Wu | 211/85.29 |

OTHER PUBLICATIONS

Product data sheet; FastTrack rail system; Rubbermaid, Inc.; www.rubbermaid.com, 3 pages (2008).

(Continued)

*Primary Examiner* — Jennifer E. Novosad
(74) *Attorney, Agent, or Firm* — Lempia Summerfield Katz LLC

(57) ABSTRACT

An organizer assembly system includes a track having a base and a bar coupled to, and spaced from, the base to form an I-beam having a longitudinal axis. The base is configured for attachment to a first mounting surface or a second mounting surface, and the bar is configured as a rail in a plurality of rail orientations of varying lengthwise rotation of the track about the longitudinal axis. A first organizer item of the system has a runner to engage the bar of the track in a first rail orientation of the plurality of rail orientations in which the track is attached to the first mounting surface and the runner rides upon a first surface of the bar such that the track supports the first organizer item relative to the first mounting surface. A second organizer item of the system has a hook to engage the bar of the track in a second rail orientation of the plurality of rail orientations in which the track is lengthwise rotated from the first rail orientation and attached to the second mounting surface such that the hook engages a second surface of the bar that supports the second organizer item to suspend the second organizer item along the second mounting surface.

18 Claims, 14 Drawing Sheets

OTHER PUBLICATIONS

Product data sheet; Under Sink Organizer—Multi-use Basket; Stacks and Stacks; www.stacksandstacks.com, 1 page (2008).

Product data sheet; Undersink Organizer—Slide Out Tray; Stacks and Stacks; www.stacksandstacks.com, 1 page (2008).

* cited by examiner

VERSATILE TRACK FOR STORAGE AND ORGANIZATION

BACKGROUND OF THE DISCLOSURE

1. Field of the Disclosure

The present disclosure is generally directed to storage devices and organizers, and more particularly to systems, assemblies and devices involving a variety of storage and organizer arrangements.

2. Description of Related Art

Storage devices and organizers are commonly found throughout a household in various settings. Organizers are used in kitchens, bathrooms, and garages, to name but a few of the areas and contexts. In each of these contexts, the organizers are often tailored to accommodate the articles to be stored. As a result, an organizer for a bedroom closet may differ markedly in shape, form, function, etc. from those used in kitchens or garages. The differences may relate to the assembly of components that forms a container or other storage mechanism, as well as to the manner in which the storage mechanism is mounted or installed.

A variety of different mechanisms have been used for mounting storage devices in garages and other areas in the house. In some cases, slots are presented to receive items shaped for insertion into the slots. One example of this type of storage system is described in U.S. Pat. No. 5,775,521. Other examples present a rail or track, such as the FastTrack Garage Organization System commercially available from Rubbermaid. These track rails can be mounted on a wall and used with hooks to hang items along the wall. U.S. Pat. No. 5,960,967 describes an example of a track arrangement for hanging items from a ceiling.

Unfortunately, many track-based storage systems have been constructed and designed for areas in which a substantial amount of space is available. Garages, for instance, often present a great deal of wall space and are well suited for running a track at various heights. In contrast, some areas within the house, such as kitchens, may have minimal wall space available, instead presenting a number of limited storage opportunities in and around cabinets and other fixtures.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
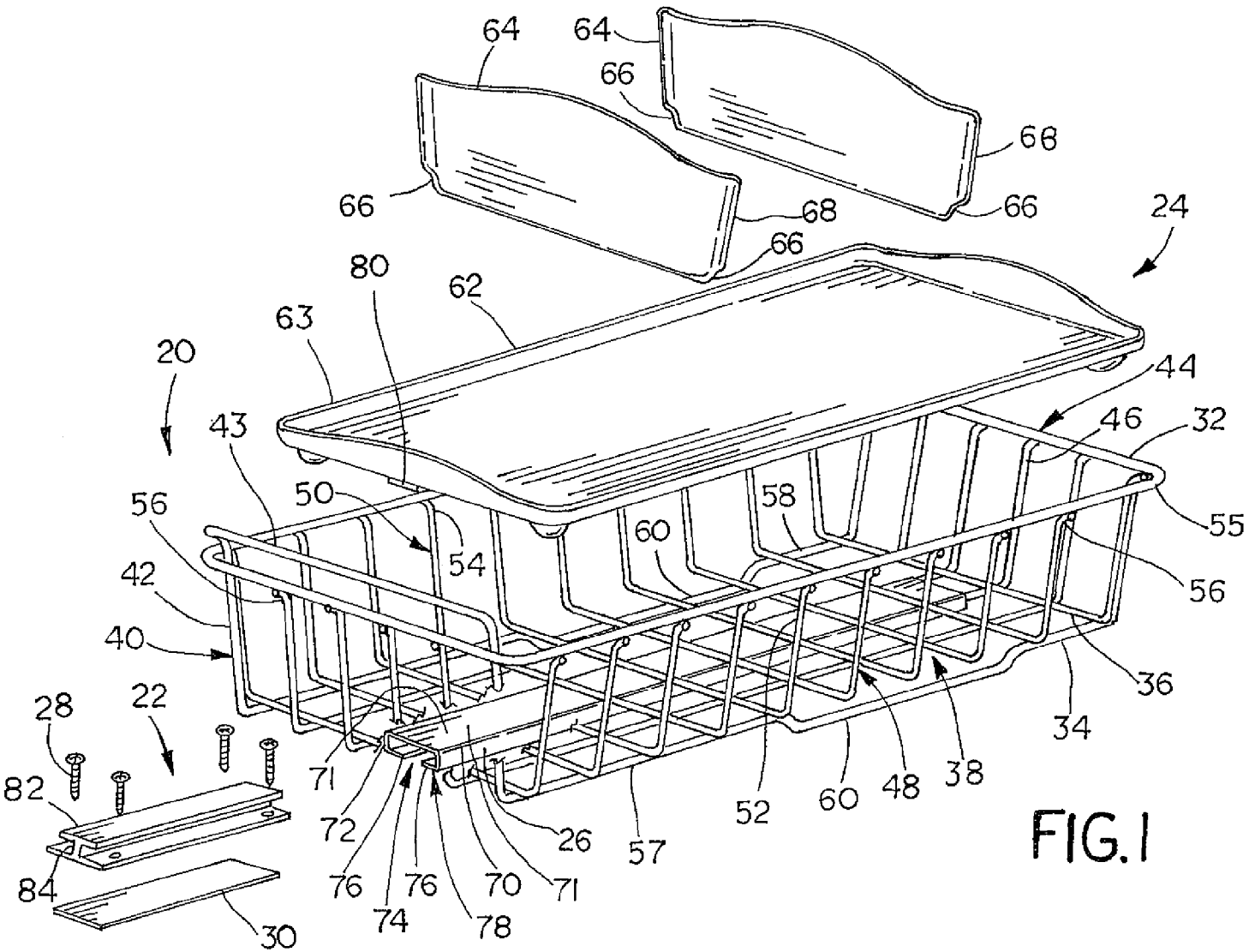
FIG. 1 is an exploded, perspective view of one example of a slide drawer assembly of a storage system having a track mounted in an upright orientation and constructed in accordance with one aspect of the disclosure.

The disclosure is generally directed to storage and organizer systems, assemblies and devices in which a track is mountable in a plurality of orientations. The varying ways in which the track can be mounted supports a variety of storage options as well as a number of different arrangements of storage items. The plurality of orientations generally dispose the track in varying degrees of lengthwise rotation about its longitudinal axis. Of the different orientations described below, organizer items may, for example, rest upon the track, hang laterally from the track, or be suspended from the track. In these ways, the track of the disclosed storage systems acts as a versatile mounting mechanism that can accommodate a diverse set of storage devices (or items) and assemblies in a wide variety of installations, applications, and contexts. The disclosed systems may accordingly include a set of interchangeable storage items compatible with the track, several examples of which are described below.

One unique challenge addressed by the disclosed systems involves the installation of storage systems within kitchens and other household areas in which limited space is available. In kitchen areas, the systems can be installed in and around cabinets and other fixtures. Within each of these areas, the same track of the disclosed systems can be mounted to a wall, floor, or ceiling without requiring any additional or different hardware. The space within a cabinet provides a number of mounting surfaces for which the track is well suited. Examples involving interior cabinet space are described below in which the track is mounted to an underlying floor or shelf, an overhead ceiling, a side wall, and a door.

In each context and application, the track generally engages one or more storage or organizer items or devices. Some items may be configured to slide along the track, while others are suspended or otherwise disposed in a stationary manner. To secure the engagement of the storage items, the track may have an I-beam shape. As described and shown in several examples, the track may include (i) a base strip or bar for attachment to a mounting surface, and (ii) a rail or support bar spaced from the base strip by a stem.

The track may be symmetrical about its longitudinal axis and/or a plane in which the stem is disposed. The symmetry of the rail provides the versatility to support and engage organizer items in a variety of mounting orientations. For instance, the track may be mounted on both horizontal and vertical surfaces, such that the rail is disposed in either horizontal (upright or inverted) or vertical orientations. In some cases, the rail and the stem may form a T-shaped projection extending orthogonally from the base strip. In that way, the track may have a pair of grooves symmetrically arranged on either side of the T-shaped projection.

The organizer and storage systems of the disclosure utilize the track to support any combination of the exemplary storage devices and items described below. Among those shown and described are cabinets, storage bins, drawers, and baskets, as well as storage racks, trays, and hooks. These and other exemplary storage and organizer items can be mounted and arranged in various installation positions and contexts using the track. Although several examples of organizer and storage items are described, practice of these and other aspects of the disclosure is not limited to the storage and organizer items and devices described and shown herein. Similarly, although several of the examples involve installation within a cabinet, practice of these and other aspects of the disclosure is not limited to the cabinet or kitchen context. Rather, the examples set forth herein are provided with the understanding that the disclosed systems and assemblies are well-suited for use with a wide variety of storage and organizer items and devices. Indeed, the wide applicability and utility of the disclosure follows from the versatility and compatibility of the track-based aspects of the disclosed systems and assemblies.

Turning now to the drawing figures, FIG. 1 shows an exemplary storage system indicated generally at 20 having a track 22 and a slide drawer or basket assembly indicated generally at 24 that engages the track 22. In this example, the slide drawer assembly 24 is shown in exploded form to reveal a runner or slide 26 shaped to allow the assembly 24 to travel along the track 22. In this way, the assembly 24 can be repositioned relative to a horizontal surface (not shown) on which the track 22 is mounted in an upright orientation. As a result, the slide drawer assembly 24 rests upon or above the track 22 and the underlying horizontal surface, which may be, in one exemplary installation or context, a shelf or a base surface inside a cabinet (not shown). The track 22 may include any number of fasteners, including, for example, screw fasteners 28 and/or one or more adhesive strips 30 to securely mount the track 22 to the horizontal surface.

The slide drawer assembly 24 may be a wireframe basket with a frame 32 formed by a set of longitudinal (or fore-and-aft) rods or wires 34 and transverse (or side-to-side) rods or wires 36 generally arranged in a wire grid pattern. In this example, the runner 26 is affixed to the assembly 24 under the frame 32, and may be secured to either the longitudinal rods 34 or the transverse rods 36 in any desired manner. The frame 32 has a base area or bottom 38 in which the rods 34 cross the rods 36 orthogonally. A front side or wall 40 of the frame 32 is formed from upwardly bent ends 42 of the longitudinal rods 34. Two of the ends 42 are joined by a handle rod 43 that extends forward of, and across, the front side 40 to facilitate positioning of the drawer assembly 24 along the track 22 for easy and ready access to the items stored in the drawer assembly 24. A rear side or wall 44 of the frame 32 is formed from opposite ends 46 of the longitudinal rods 34, similarly upwardly bent. Lateral sides or walls 48, 50 of the frame 32 are formed from upwardly bent ends 52 and 54 of the transverse rods 36, respectively. The front and rear sides 40 and 44 are longitudinally spaced apart and generally parallel, and the lateral sides 48 and 50 are laterally spaced apart and generally parallel. The front, rear and lateral sides 40, 44, 48, and 50 may be joined by a top rod 55 bent into a rectangular configuration when viewed from above. The top rod 55 is connected to each of the ends 42, 46, 52, and 54 to define an upper perimeter of the assembly 24. The ends 42, 46, 52, and 54 are all generally vertically oriented, but may be inclined or angled outward slightly as they approach the top rod 55. In this way, the upper perimeter of the assembly 24 is wider and longer than the bottom 3 8.

To assemble the drawer assembly 24, tips 56 of each end of the rods 34, 36 can be attached to the top rod 55 in a variety of ways. In this example, the tips 56 are bent outward to meet the top rod 55, at which point they can be welded, soldered or otherwise attached. The points of intersection in the grid pattern on the bottom 38 may also be welded, soldered or otherwise attached to form a sturdy drawer construction. To that end, the rods 34, 36 and other components of the frame 32 may be composed of any suitable materials or layers. Examples include a variety of metals, metals with a rubberized coating, and polymer materials. The rods 34, 36 of the frame 32 generally have a wire gauge and a circular cross-section with a diameter sized as desired to provide structural rigidity and support. The gauge and cross-sectional shape of the longitudinal rods 34 and the transverse rods 36 need not be circular or the same, and may otherwise vary across the frame 32. More generally, the configuration, construction, materials, dimensions and other characteristics of the assembly 24 may vary considerably, as desired. Exemplary alternatives include various molded configurations with one or more of a solid bottom, solid ends, or solid walls that are transparent, semi-transparent, translucent, or opaque.

In other cases, the front side 40 of the drawer assembly 24 may include an open front wall, a more forward tilted front wall, and/or a reduced height front wall to permit partial access to items stored in the drawer 24 without having to slide the drawer outward. The drawer assembly 24 may also take on shapes that differ from the rectangular box-like structure shown. It follows that the drawer assembly 24 need not have the longitudinal or lateral symmetry of the example shown.

Figure 2:
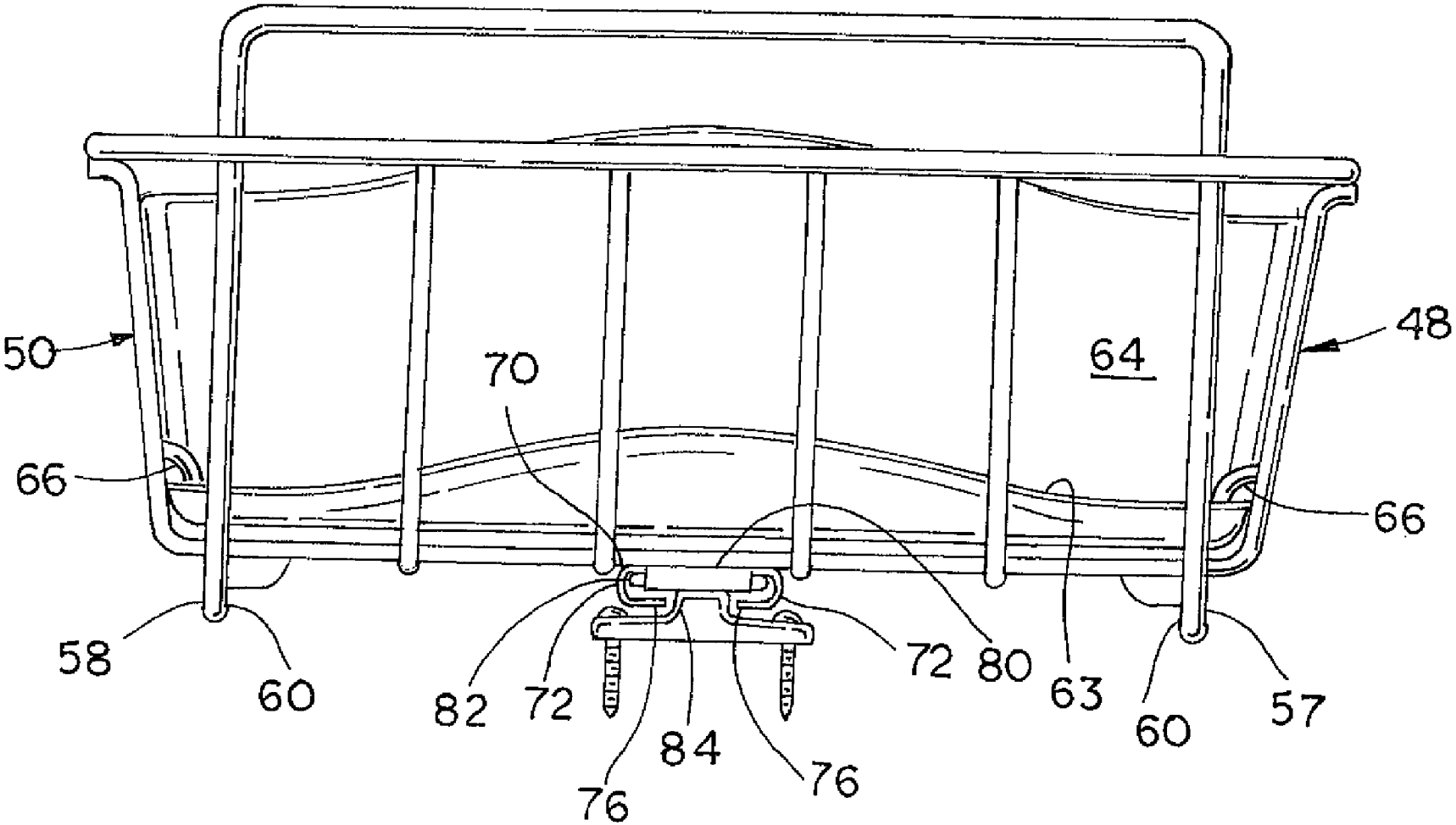
FIG. 2 is a front, elevational view of the slide drawer assembly of FIG. 1.
Figure 4:
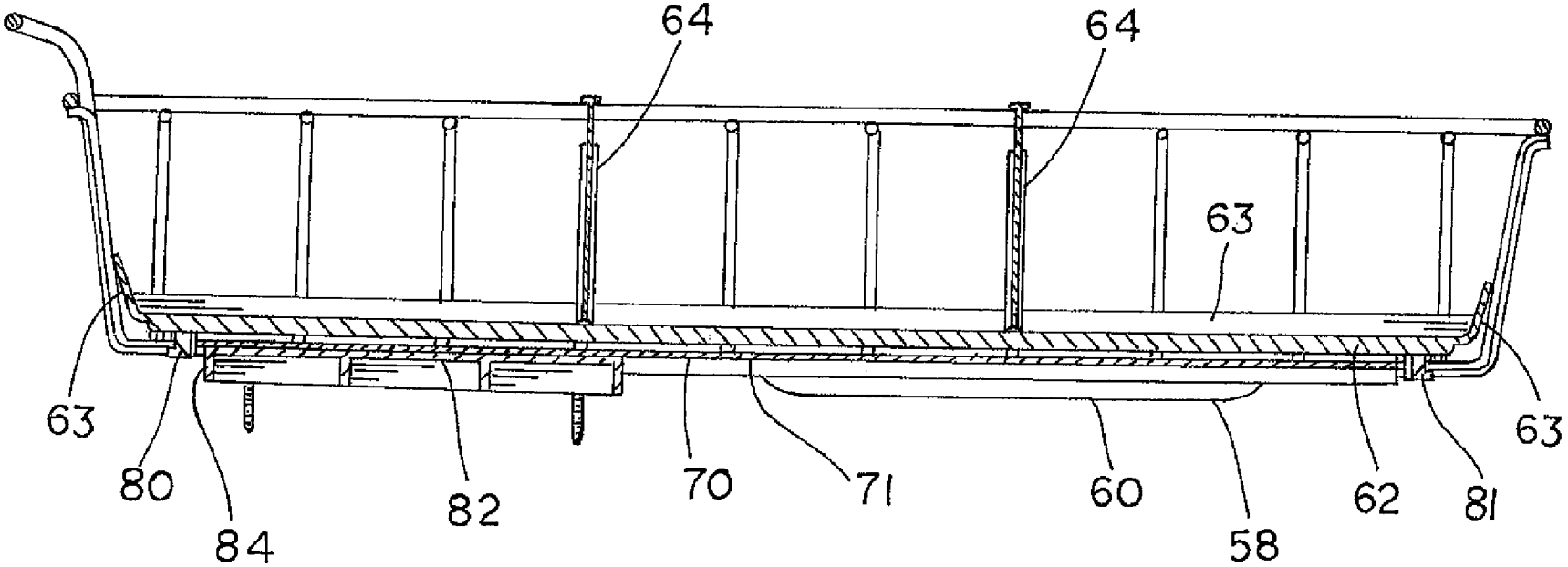
FIG. 4 is a cross-sectional view of the slide drawer assembly taken along lines IV-IV of FIG. 3.
Figure 5:
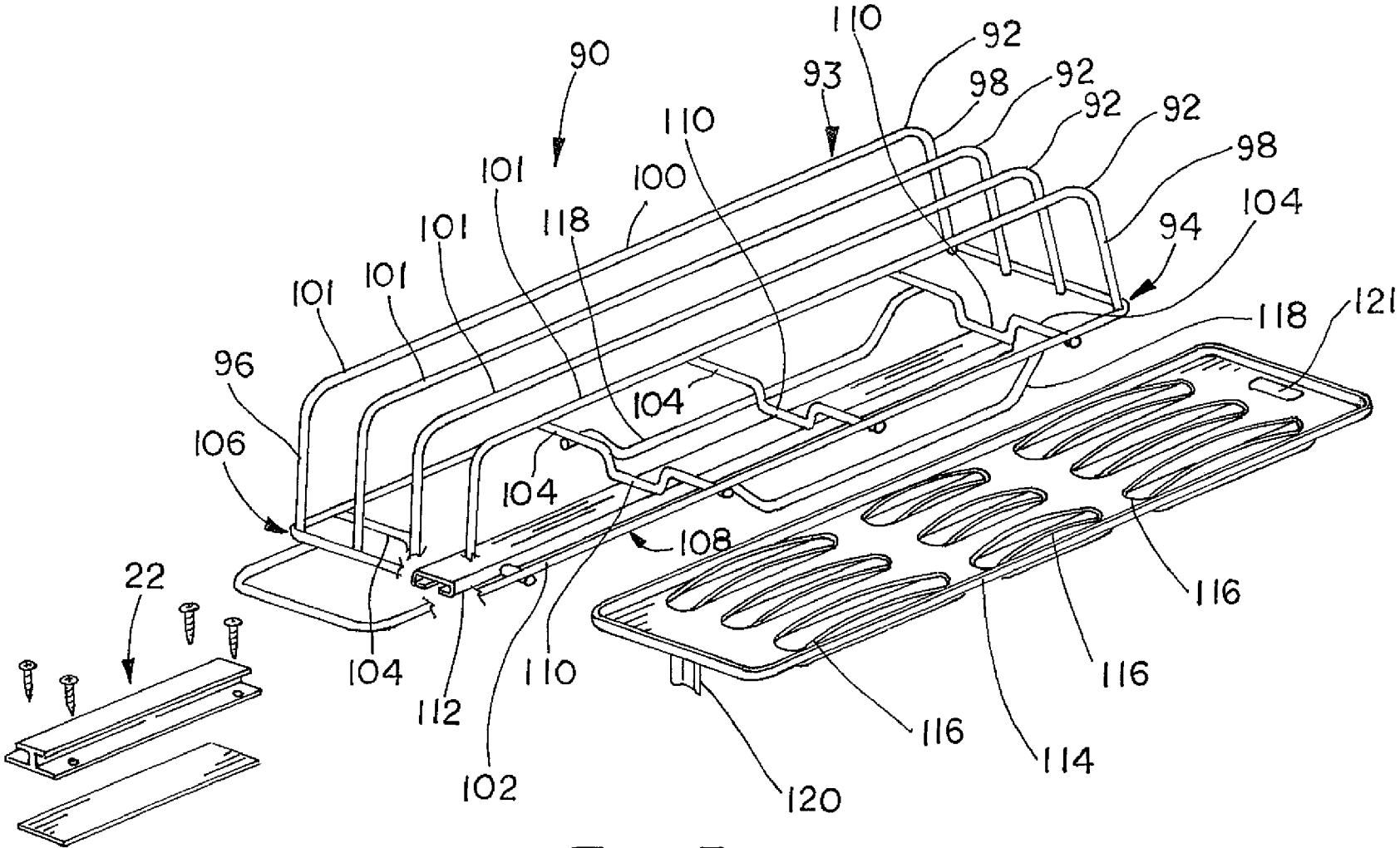
FIG. 5 is an exploded, perspective view of one example of a lid rack assembly of a storage system with the track mounted in an upright orientation.

As best shown in FIGS. 2 and 4, the frame 32 is generally configured to rest upon one or more sections of the base area 38 while sliding upon the track 22. In this case, two exterior rods 57, 58 of the set of the longitudinal rods 34 have downwardly bent runner sections 60 spaced from the transverse rods 36 to stabilize the assembly 24 when the runner 26 engages the track 22. In this example, the track 22 and the runner 26 also provide lateral and longitudinal stability. A variety of other structures may alternatively provide lateral stability for the frame 32, including those running or elongated in the longitudinal direction. Similarly, longitudinal stability may be provided by one or more projections (not shown) extending downward from the base area 38 in cases where the runner 26 does not extend a substantial length of the assembly 22. In other cases, the frame 32 may rest solely on the track 22.

Figure 3:
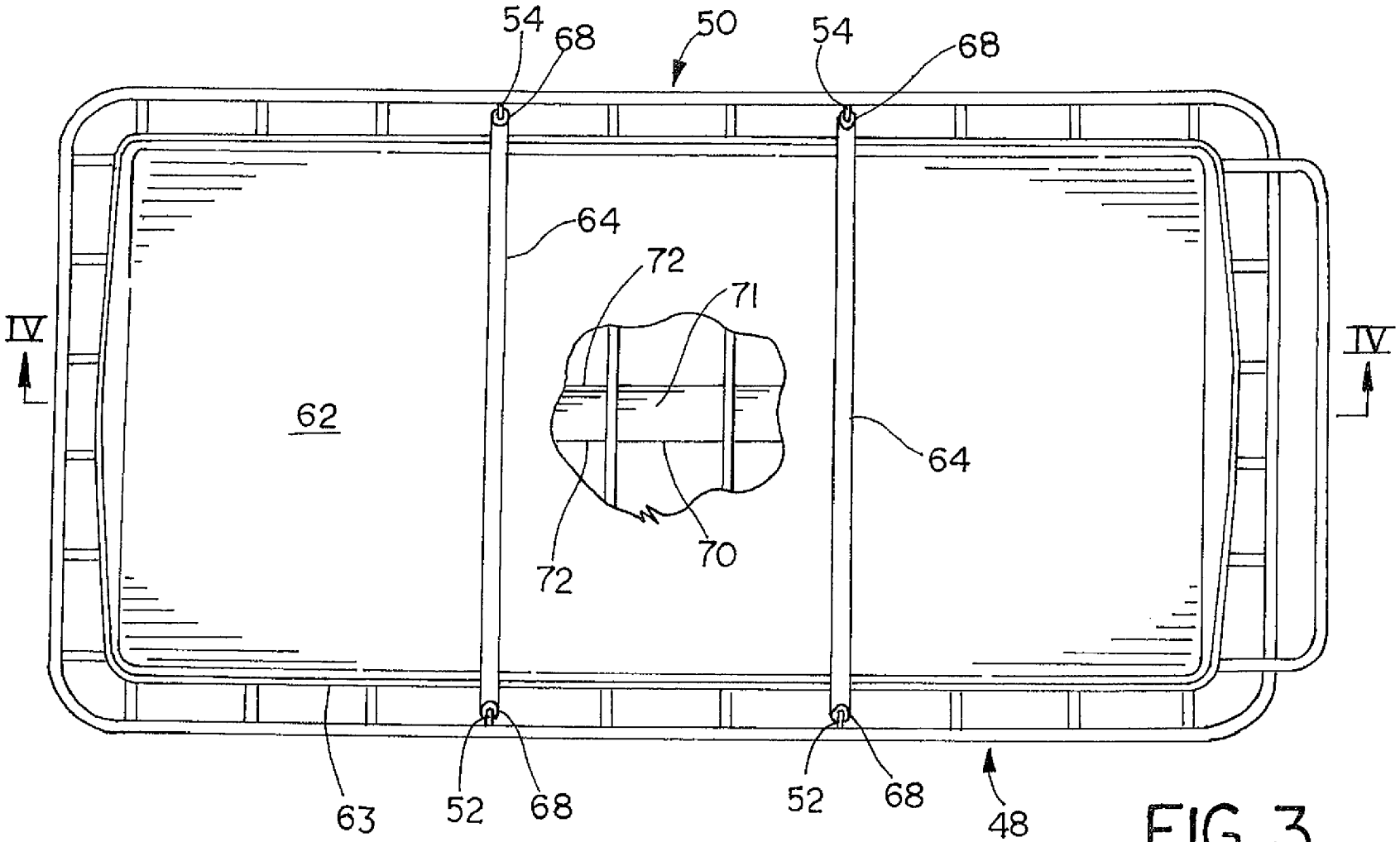
FIG. 3 is a plan view of the slide drawer assembly of FIG. 1.

With reference now to FIGS. 1-4, the drawer assembly 24 includes a removable bottom tray 62 configured and sized to rest on the bottom or base area 38. The bottom tray 62 in this example has an outstanding lip 63 to help retain items within a perimeter of the tray. The lip 63 may have a height that varies between and along sections of the perimeter as shown. The storage space above the tray 62 is divided by upright inserts 64 to create multiple storage compartments. The tray 62 and the inserts 64 may be detachable for purposes of cleaning and customization of the assembly 24. The inserts 64 generally extend transversely across the drawer assembly 24, extending between the lateral sides 48 and 50 (as best shown in FIGS. 1-3). The inserts 64 may have notched lower corners 66 (FIGS. 1-3) to accommodate the lips 63 of the tray 62 and grooved edges 68 to engage the ends 52, 54 of the transverse rods 36 as shown in FIG. 3. Both the tray 62 and the inserts 64 may vary considerably from the example shown. For instance, the insert 64 need not to be transversely oriented, need not extend the entire width of the tour assembly 24, and need not be solid as shown. Furthermore, the inserts 64 may be shaped to accommodate one or more other components of the drawer assembly 24, and sized in any desired manner.

The engagement of the track 22 and the runner 26 of the drawer assembly 24 is now described with reference to FIGS. 1-4. In this example, the runner 26 has C-shaped cross-section when viewed from an end. More specifically, the runner 26 includes a strip 70 with a generally or substantially flat central section or plane 71 and edges 72 (FIGS. 1-3) bent downward and inward along the length of the strip 70 to form the C-shaped cross-sectional shape. As best shown in FIG. 1, a gap 74 remains between ends 76 of the edges 72, while the edges 72 and the central section 71 are separated by spacing 78. Together, the gap 74 and the spacing 78 define a slide channel configured to receive the track 22. In FIG. 2, the central section 71 and the slide channel are partially obscured by a stop 80 (see also FIGS. 1 and 4) that extends downward from the tray 62 to limit rearward movement of the assembly 24 via impact with the track 22. The tray 62 also has a rear stop 81 (FIG. 4) located at the back side of the assembly 24 to limit forward movement of the assembly in a similar fashion.

The central section 71 has a width that generally sets the lateral size of the slide channel. More specifically, the lateral sizes of the gap 74 and the spacing 78, in turn, limit the lateral movement of the assembly 24 when the track 22 is engaged. To this end, the size of the spacing 78 roughly corresponds with the width of a bar 82 of the track 22, and the size of the gap 74 roughly corresponds with the width of a stem 84 of the track 22. In this way, the lateral size of the slide channel can be set only slightly larger than the track 22, so that the assembly 24 can ride the track 22 without an undesirable degree of lateral movement.

The form, length and positioning of the runner 26 may vary as desired. The runner 26 may be mounted to the frame 32 at any desired position. In this case, the runner 26 and, thus, the track 22, are centered relative to the lateral sides 48, 50 beneath the base area 38. As a result, the runner 26 extends longitudinally from the front side 40 to the back side 44. The runner 26 need not extend the entire longitudinal length of the assembly 24 and, furthermore, need not be longer than the track 22 as shown. Indeed, the track 22 may have a length shorter than, equal to, or longer than the runner 26. The lengths of the track 22 and the runner 26 may be determined with the total desired travel of the assembly 24 in mind. For instance, as the length of either the track 22 or the runner 26 increases, the track 22 provides support over a longer translation. For these reasons, the length and position of the runner 26 may vary considerably from that shown in the example of FIG. 1. The runner 26 need not be formed from a one-piece strip, as in the example shown, but rather may have any number of components or units of any desired shape to define the slide channel in which the track 22 is received.

As the runner 26 travels on the track 22, the upright orientation of the track 22 allows the bar 82 to act as a rail for the assembly 24. The bar 82 may be shaped as an elongated strip of a thickness suitable for receipt within the height of the slide channel of the runner 26. The thickness of the bar 82 may also be selected in accordance with the expected load of the assembly 24. The stem 84 may act as an elongated spine to provide structural support for the bar, and may be sized in accordance with the expected load as well. In this case, the runner 26 wraps around the bar 82 to securely slide along the track 22 and substantially prevent any significant upward displacement of the assembly 24 relative to the track 22. In other cases, the runner 26 forms a channel without ends or edges disposed beneath the bar 82. As a result, the runner 26 merely rides upon the track 22, such that the assembly 24 can be lifted off the track 22. Further details regarding exemplary tracks are set forth below in connection with FIGS. 9-1 1.

Figure 6:
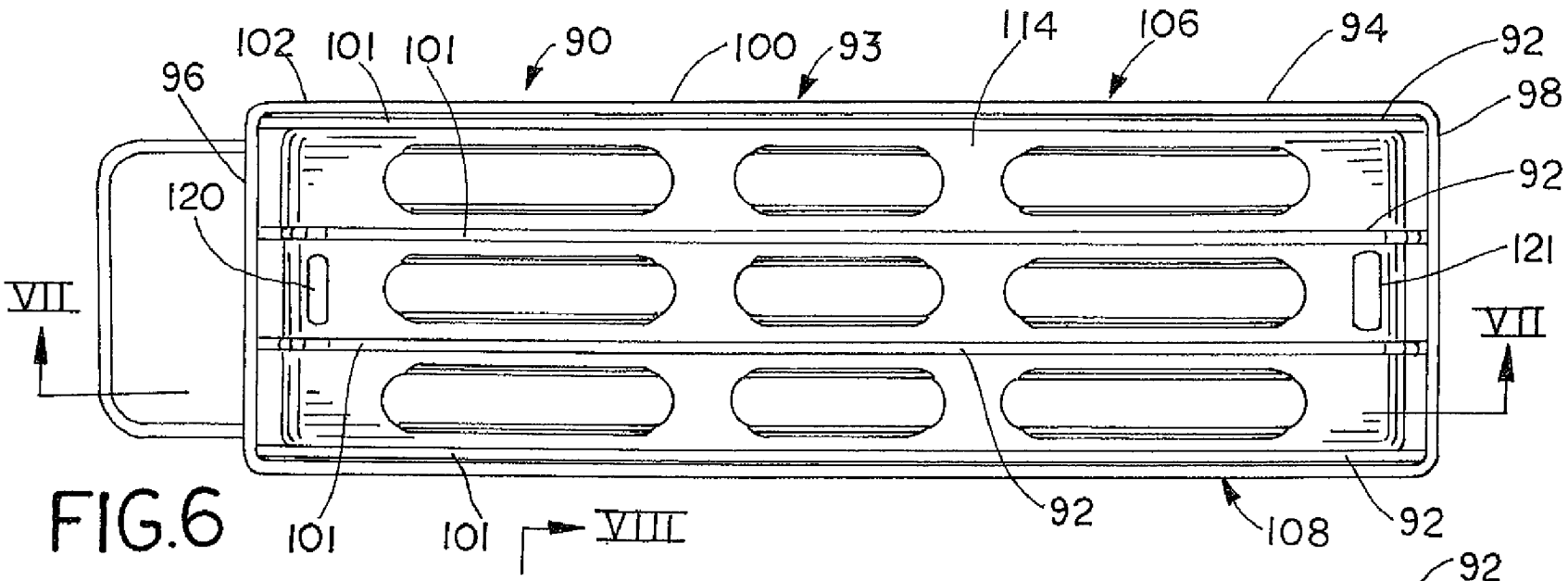
FIG. 6 is a plan view of the lid rack assembly of FIG. 5.
Figure 7:
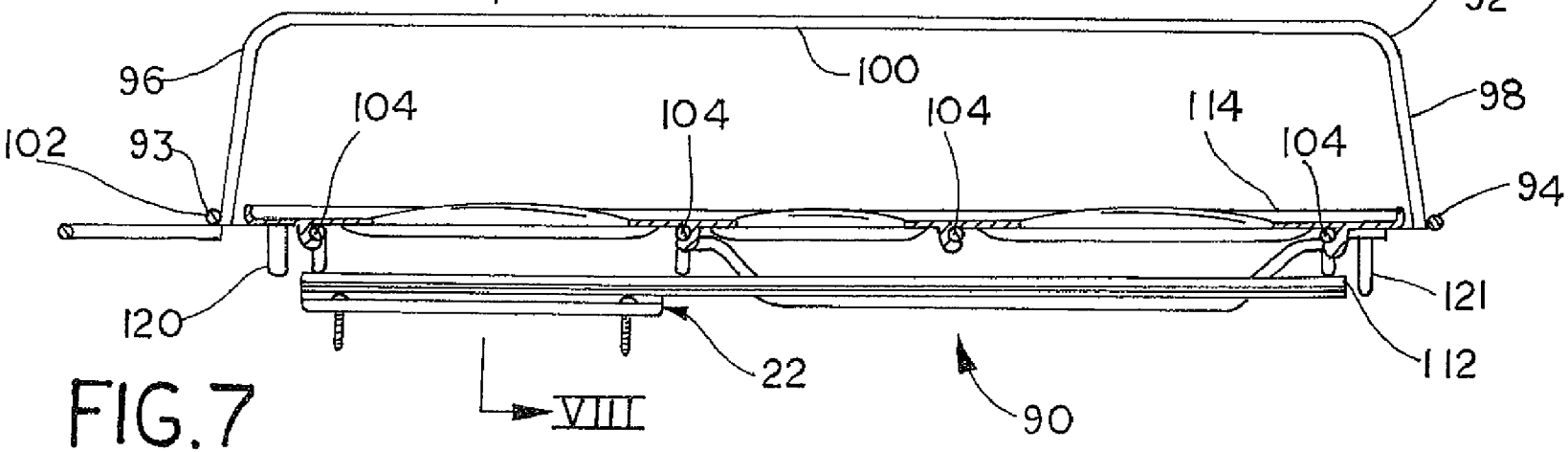
FIG. 7 is a cross-sectional view of the lid rack assembly taken along lines VII-VII of FIG. 6.
Figure 8:
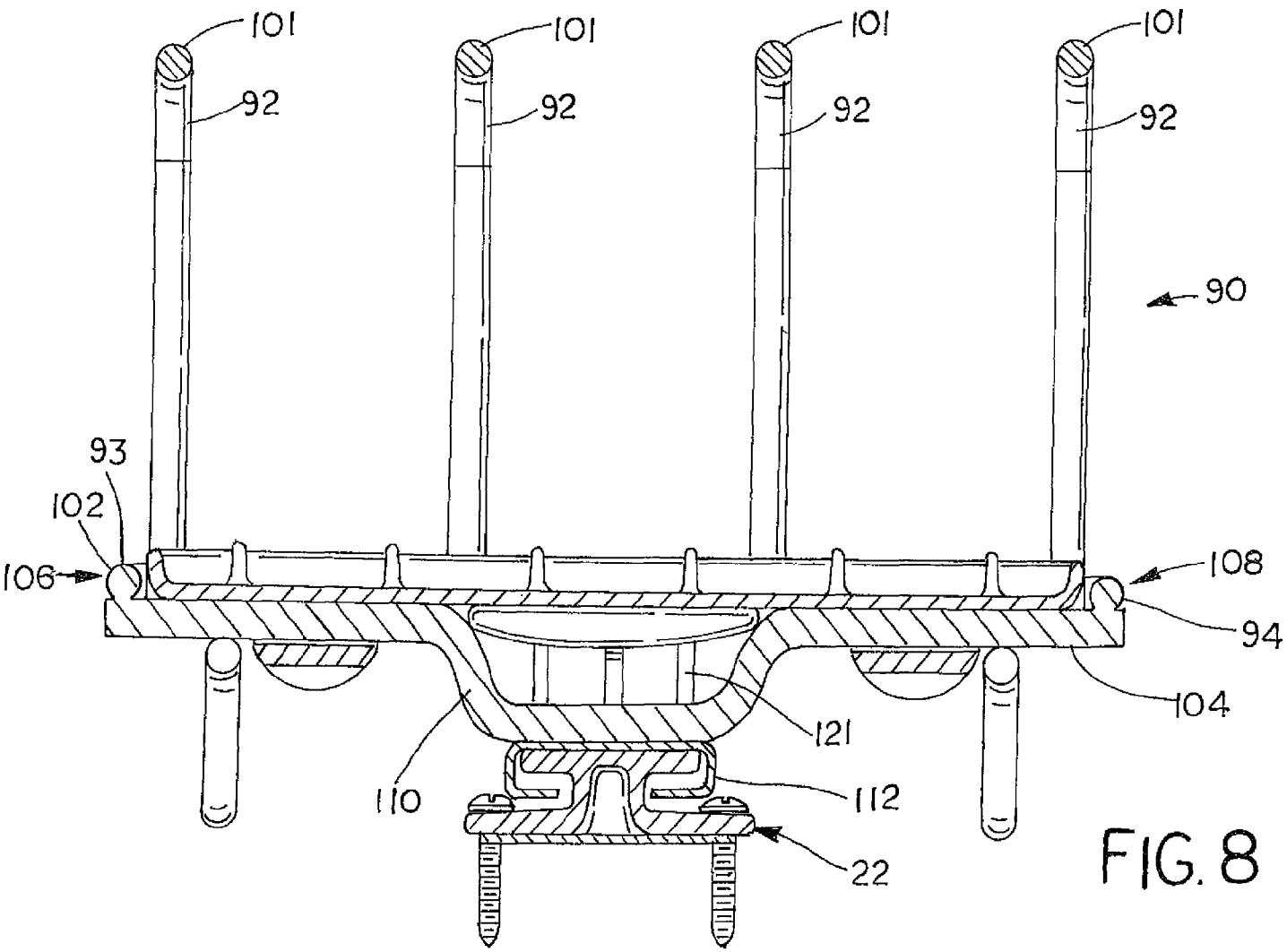
FIG. 8 is a cross-sectional view of the lid rack assembly taken along lines VIII-VIII of FIG. 7.

Turning now to FIGS. 5-8, a storage rack assembly 90 is another exemplary storage device or item of the storage system 10 based on, and compatible with, the track 22. The assembly 90 is useful for storing container lids and other objects having a profile conducive to a storage arrangement between upright racks 92 of a wire frame indicated generally at 93. In this example, each track 92 includes one or more rods or wires spaced apart from one another and mounted on a base 94 of the wire frame 93. Specifically, the racks 92 are defined by rods shaped to present a front section 96, a rear section 98, and a central section 100, of the assembly 90. The rods are oriented longitudinally in the central section 100 to connect the front and rear sections 96, 98. In this example, each rack 92 includes a single rod 101 bent in a U-shaped configuration and connected to a rectangular rod 102 that forms a perimeter of the base 94. The rods 101 may be inclined or angled slightly inward in the front and rear sections 96, 98, rising from the base 94, as best shown in FIG. 7. The rods 101 are generally disposed in parallel with one another to provide a consistent spacing for the items to be stored. The base 94 includes transverse rods 104 that extend transversely across lateral sides 106, 108 of the base 94, as best shown in FIG. 6 and 8. Each transverse rod 104, in turn, includes a central, downward indentation 110 (FIGS. 5 and 8) to which a runner 112 is attached. The indentations 110 establish a lower level or height for the runner 112, spacing the runner 112 from the base 94 so as to provide room for storage items disposed on the assembly 90. In other words, the indentations 110 space the racks 92 and the storage space defined thereby sufficiently above the surface on which the system is mounted. Lids, dishes and other items (not shown) may then extend below the level of the base 94 as they are disposed on end between the racks 92. The storage items may be held in place between the racks 92 by a tray 114 having slots 116 of varying size to receive the items. In this example, the tray 114 has downward projecting hooks 117 best shown in FIG. 7 configured to engage the transverse rods 110 for secure but removable attachment with the frame 93. The hooks 117 may be of molded construction along with the rest of the tray 114. The construction of the frame 93, the tray 114, and other components and characteristics of the rack assembly 90 may vary considerably, as desired.

The runner 112 and other aspects of the rack assembly 90 provide for a sliding storage system in a manner similar to the drawer assembly 24 described above. Generally speaking, the two assemblies 24 and 90 are configured to provide storage space above a mounting surface upon which the track 22 is disposed in an upright orientation. As a result, the track 22 again acts as a rail, as described above, upon which the rack assembly 90 can travel. To that end, the runner 112 may be mounted, constructed and otherwise configured as described above (in connection with the runner 26) to engage the track 22.

Other aspects and components of the rack assembly 90 may be constructed, connected, and arranged in similar fashion to those described above in connection with the drawer assembly 24. For instance, the rack assembly 90 includes a pair of exterior runner rods 118 to complement the runner 112 that, as in the above-described example, is centered between the sides 106 and 108. The rods 118 are connected to the perimeter rod 102 and bent downward to a level to contact the mounting surface and provide lateral stability. The tray 114 includes stops 120 and 121 to limit travel of the assembly 90 via impact with the track 22. The formation of the slide channel and other aspects of the interaction and engagement of the assembly 90 and the track 22 are similar to that described above.

Figure 9:
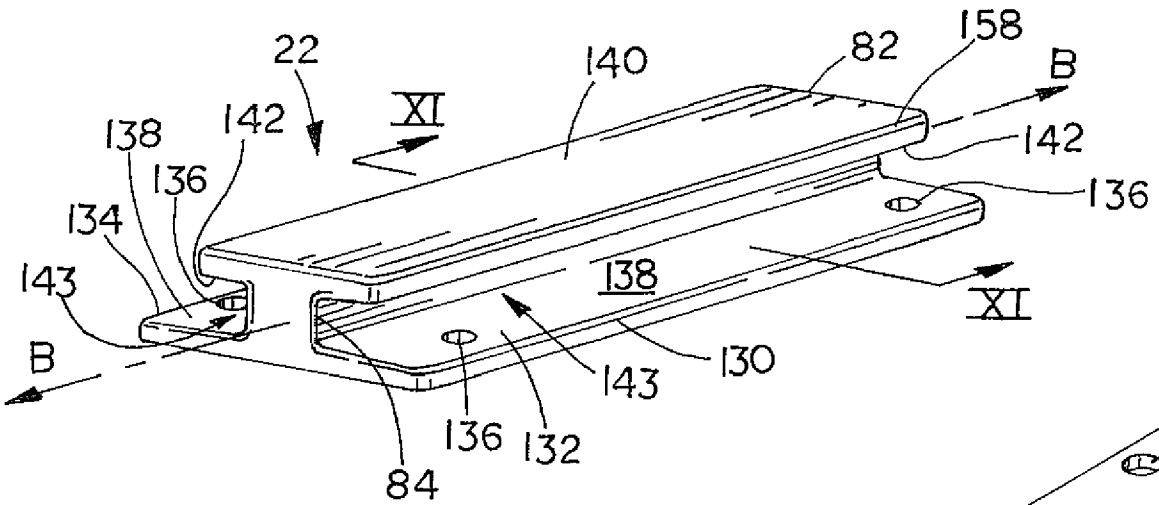
FIG. 9 is a perspective view of the track in an upright orientation and configured in accordance with one aspect of the disclosure.
Figure 10:
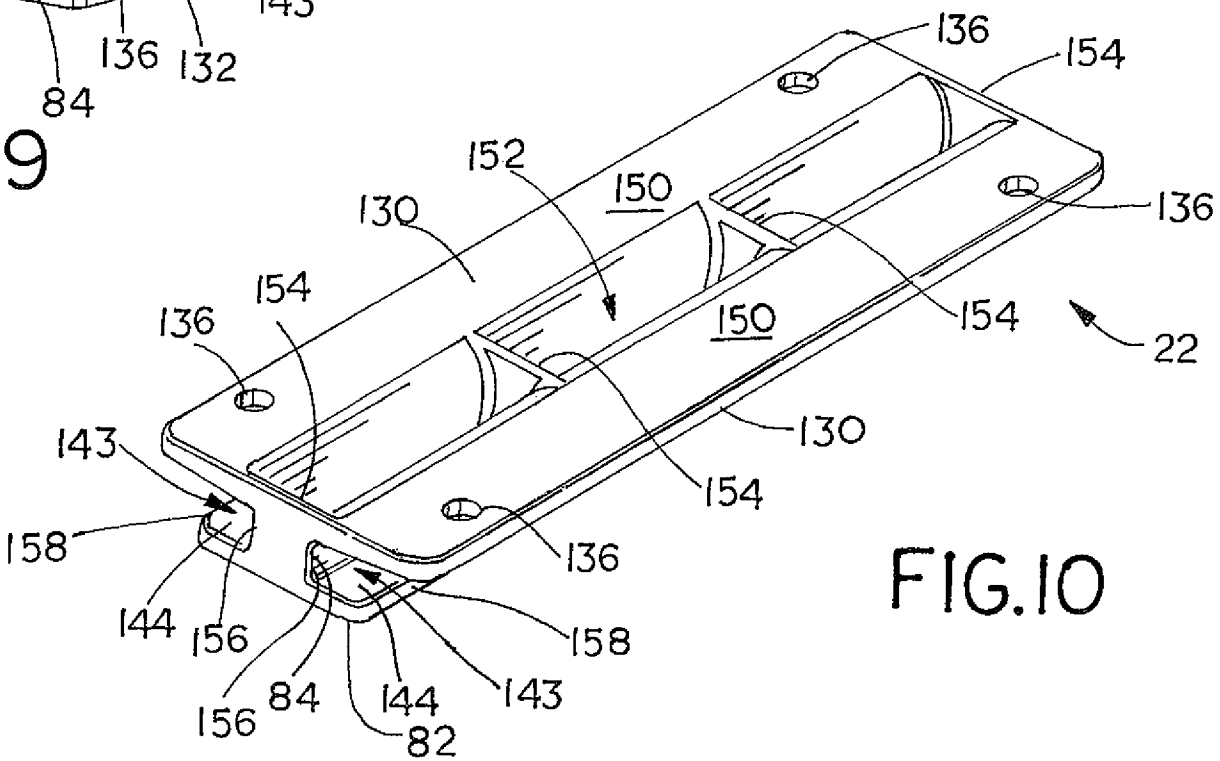
FIG. 10 is a perspective view of the track of FIG. 9 in an inverted orientation.
Figure 11:
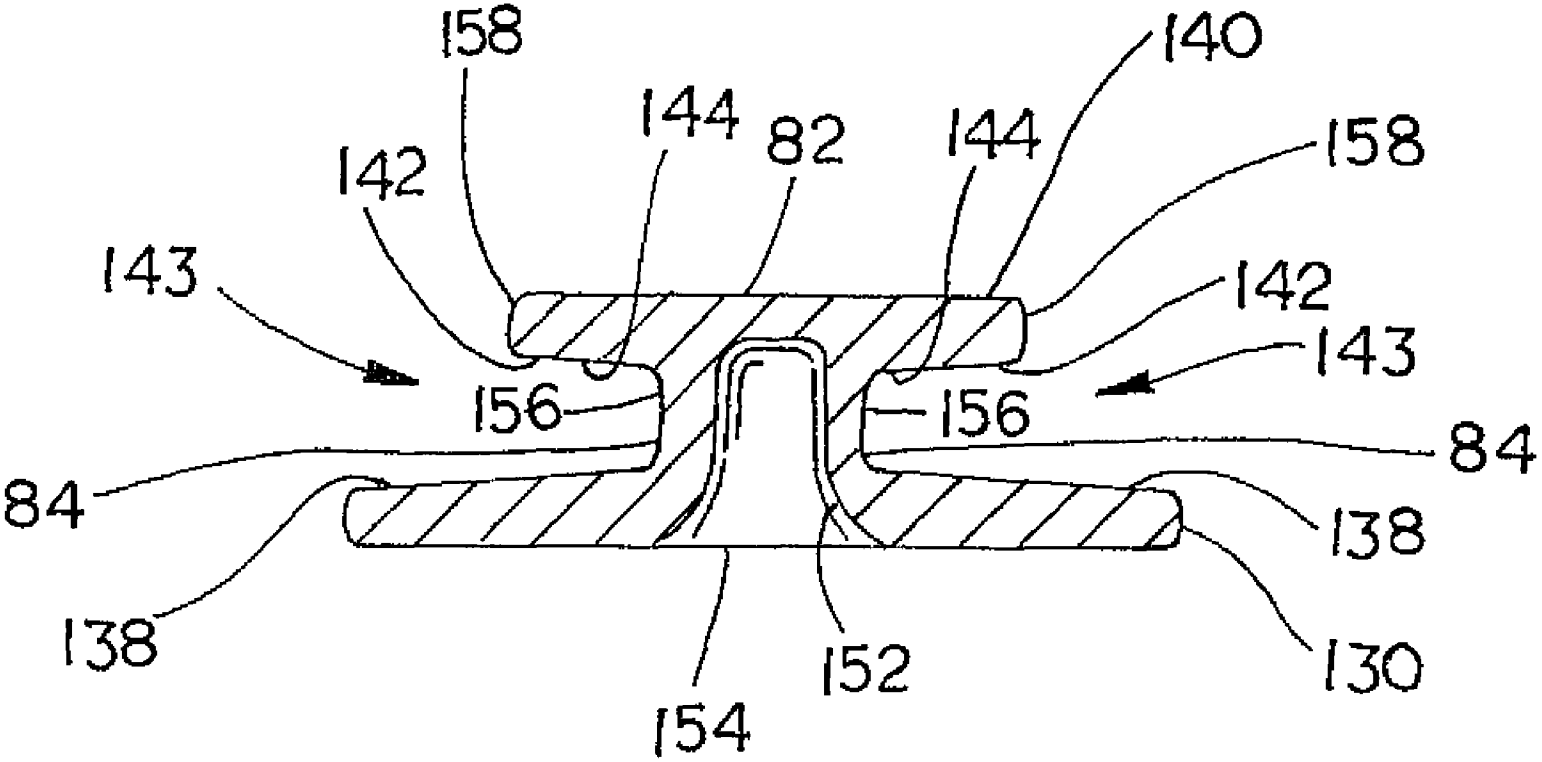
FIG. 11 is a cross-sectional view of the track taken along lines XI-XI of FIG. 9.

The track 22 of the above-described storage system 10 is shown in greater detail in FIGS. 9-11. Generally speaking, the track 22 has a configuration well-suited for different mounting orientations and, as a result, different storage items or devices. The examples described above utilized the track 22 in a horizontal, upright orientation, but other orientations are addressed below. One aspect of the track 22 that supports this versatility is the lateral symmetry relative to the bifurcating line B-B shown in FIG. 9. The bifurcating line B-B runs as a longitudinal axis of the track 22. The track 22 is also symmetrical with respect to the upright and lateral planes that also run the length of the track 22 and contain the longitudinal axis. Other supportive aspects of the track 22 include the configuration of the stem or spine 84 and the bar 82. In this example, both the bar 82 and the stem 84 extend the length of the track 22 for both lateral and longitudinal stability and durability. Furthermore, both the bar 82 and the stem 84 have a number of generally or substantially flat surfaces that promote sliding travel of assemblies that primarily rest or slide upon one or more of the surfaces. Moreover, these surfaces may also be generally broad enough to provide a secure and stable engagement for the assemblies. Still further, adjoining surfaces may be generally squared with respect to one another to establish a rectilinear configuration well-suited for mounting to both horizontal and vertical surfaces. Notwithstanding the foregoing, the track 22 is not limited to use with horizontal or vertical mounting surfaces, but rather may be useful with various angled surfaces and mounting orientations.

Turning now to FIG. 9, the track 22 is shown in an upright orientation in which the bar 82 is disposed above a mounting or base strip 130 of the track 22. Regardless of the orientation of the track, the mounting strip 130 is configured to secure the track 22 to a mounting surface (not shown). In the upright orientation shown, the bar 82 and the storage item or assembly engaging the track 22 are disposed above the mounting surface. The mounting strip 130 may, but need not, be an elongated, unitary base running the length of the track 22 as shown. The mounting strip 130 is coupled to, and spaced from, the bar 82 by the stem 84. In this example, the mounting strip 130 has a thickness similar to that of the bar 82 and, thus, may be considered a bar, or bar-shaped, as well. The mounting strip 130 includes lateral flange sections 132 and 134 on either side of the stem 84, each of which may include one or more orifices 136 to receive a fastener (not shown), such as a screw fastener. Each lateral flange section 132, 134 presents a generally or substantially flat or smooth surface 138 to promote sliding in the event that a runner or other component of a storage item rests thereupon.

The bar 82 of the track 22 generally includes a central, elongated surface 140 that may act as a single beam, or monorail, in the upright orientation for a runner or other component of a storage assembly or item. The surface 140 is also generally or substantially flat or smooth to support slidable engagement. The surface 140 is spaced from, and generally parallel to, the surfaces 138, such that the bar 82, the stem 84, and the mounting base 130 collectively have an I-beam shape as shown. In this example, the bar 82 and its surface 140 project or extend beyond the stem 84 to form overhangs 142 spaced from the mounting strip 140. In this way, the overhangs 142 define a pair of matching notches or grooves 143 to receive an object wrapping around, or otherwise disposed under the bar 82. The grooves 143 are symmetrically disposed relative to the longitudinal axis of the track 22 and the upright and lateral planes in which the axis is disposed. As best shown in FIGS. 10 and 11, each overhang 142 includes a smooth or flat surface 144 to promote sliding engagement. The surface 144 is generally parallel to the surfaces 138 and squared relative to the stem 84. As a result, the resulting notch or groove is generally rectangular or squared. The surface 144 is also generally parallel to the surface 140, as shown in FIG. 9.

In the upright orientation, the load of a storage assembly or item may be supported primarily by the surfaces 138 and/or 140, although other surfaces of the track 22, such as those of the stem 84, may also be contacted. As described above in the examples of FIGS. 1-8, engagement of the track 22 in the upright orientation may involve a runner or other object wrapping around the bar 82. In those and other cases, the surface 144 of the bar 82 may act as a retaining surface to prevent undesired (e.g., upward or vertical) displacement of the storage item engaging the track 22. Further details and examples of retaining or guide surfaces of the track 22 to prevent undesired (e.g., lateral) displacement of a storage item are described below.

Slidable engagement of the track 22 in the upright orientation is also generally facilitated by the parallel arrangement of the surfaces 138, 140. The surfaces 138 and 140 are generally squared relative to the stem 84. As a result, the surfaces 138, 140 are generally horizontal when the track 22 is disposed in the upright orientation shown, while the stem 84 is generally vertical. In some cases, one or more of the interfaces between the stem 84 and the surfaces 138, 140 may be rounded slightly, as shown.

In some cases, one or more of the above-described surfaces of the track 22 (e.g., surfaces 138 and 142) may be disposed on a slight incline (or decline) as the surfaces approach the stem 84. As best shown in the example of FIG. 11, the surfaces 138 may incline slightly, rising to meet the stem 84, which may be, for example, to facilitate manufacturing or assembly, or increase the robustness of the track 22. The surfaces 144 of each overhang 142 may also decline slightly as shown in FIG. 11 for similar reasons. Thus, for purposes of this disclosure, the terms "generally," "substantially," and the like, as applied herein with respect to parallel, orthogonal, vertical or horizontal orientations of various surfaces or components are intended to mean that the surfaces or components have a primarily parallel, orthogonal, vertical or horizontal orientation, but need not be precisely parallel, orthogonal, vertical or horizontal in orientation. In many instances, the surfaces or components may be slightly angled to parallel, orthogonal, vertical or horizontal to permit some permissible offset (e.g., manufacturing tolerance), or to imply some intended offset, from the reference to which these types of modifiers are applied herein.

The I-beam shape of the exemplary track 22 shown and described does require or imply that the widths of the bar 82 and the base 130 are equal. On the contrary, the term "I-beam" is used herein to include tracks with unequal widths of the bar and base. That is, the relative widths of the bar, base and stem of the track 22 can vary between embodiments and within the same embodiment.

FIG. 10 depicts the track 22 in an inverted orientation in which the mounting strip 130 is disposed above the bar 82. A contact surface 150 of the mounting strip 130 attaches to a ceiling or other overhead object (not shown) from which a storage assembly or item is suspended via the track 22. The contact surface 150 is generally or substantially flat and need not be separated by the stem 84 into two sections as shown. In this example, the contact surface 150 does not extend the full width of the mounting strip 130, but instead a cavity 152 extends into the stem 84. The cavity 152, in turn, may be divided by ribs 154 spaced over the length of the track 22. In other examples, the contact surface 152 covers the fall extent of the mounting strip 130. More generally, the contact surface 150 is also generally parallel with the surfaces 144 of the overhangs 142.

In the inverted orientation, the bar 82 again bears the load of the storage assembly or item engaging the track 22. However, now the storage assembly or item rests upon the surfaces 144 of the bar 82. As a result, the surfaces 144 act as support surfaces rather than as retaining surfaces (in contrast with their purpose in the upright orientation).

A number of other components or surfaces of the track 22 may serve as guides or retaining surfaces in both the upright and the inverted orientations. For example, opposing surfaces 156 of the stem 84 may prevent lateral movement, thereby restricting movement to the direction of the track 22 (i.e., the longitudinal direction). Similarly, side edge or end surfaces 158 of the bar 82 may limit or prevent such lateral movement. Undesired upward displacement may be limited by the surfaces 138 of the base 130 or the surface 140 of the bar 82.

As shown and described below, the track 22 can also be used in orientations in which the track 22 has been rotated lengthwise (along the longitudinal axis or, for instance, the line B-B of FIG. 9) to meet non-horizontal mounting surfaces. For example, one other orientation involves mounting to a vertical wall or surface. In that case, the track 22 has been rotated 90 degrees from the orientations shown in FIGS. 9-11 to reach a vertical orientation in which the surface 140 of the bar 82 and the surfaces 138 of the mounting strip 130 are vertically disposed. In short, the T-shaped projection of the track 22 extends laterally from the mounting surface.

The vertical orientation utilizes different surfaces or components of the track 22 to support the load of a storage assembly or item. For example, the surfaces 138, 140, and 144 no longer act as load-bearing support surfaces (as shown in FIGS. 1-8), but rather act as guides or retaining surfaces. Conversely, those surfaces of the track 22 that guide or retain in the upright and inverted orientations may act as support surfaces in the vertical orientation. For example, the storage assembly or item can rest on one of the end surfaces 158 of the bar 82. Alternatively or additionally, the storage assembly or item can be supported by one of the surfaces 156 of the stem 84.

In other non-horizontal orientations, the various surfaces of the track 22 may act as both support and guide surfaces. These cases generally involve mounting surfaces that are neither vertical nor horizontal. For example, if the surface on which the track 22 is mounted is inclined 45 degrees from horizontal, then the load of a storage assembly or item engaging the track 22 may bear, in part, on both the surface 140 and one of the end surfaces 158. Thus, one or more of the surfaces of the track 22 may act as both a guide and a support depending on the mounting orientation.

As shown in FIGS. 10 and 11, the track 22 may have a molded configuration in which the track 22 has a one-piece construction. Various materials may be used and, in some cases, more than one material or material layer may be incorporated to provide varying functionality. For instance, some components of the track 22 may have an outer layer with a tacky substance to act as a gripping surface, while others may have a smooth surface that presents a low degree of friction, drag, or resistance to sliding.

Figure 12:
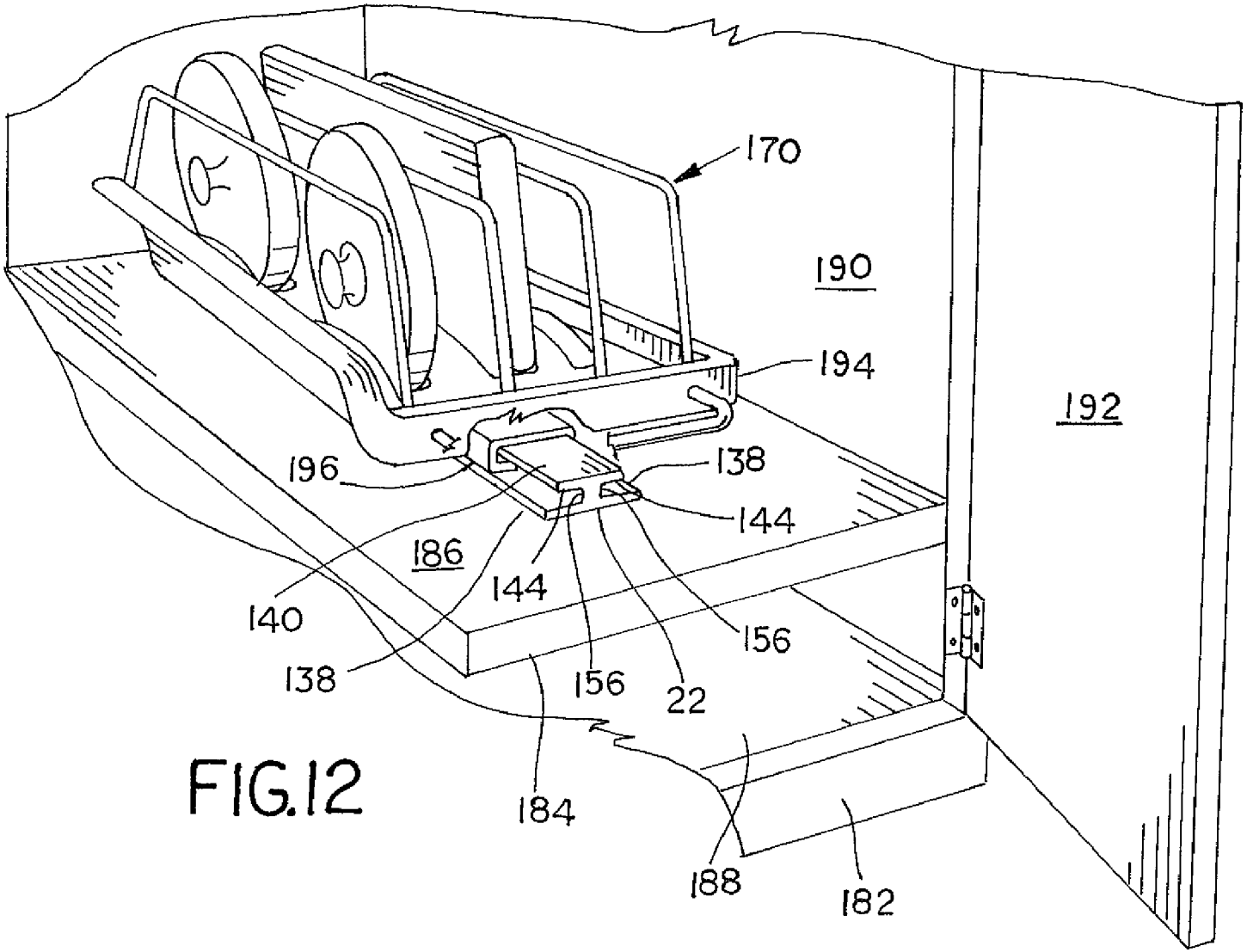
FIG. 12 shows one example of a lid rack assembly of a storage system installed within a cabinet via a track mounted in an upright orientation.
Figure 13:
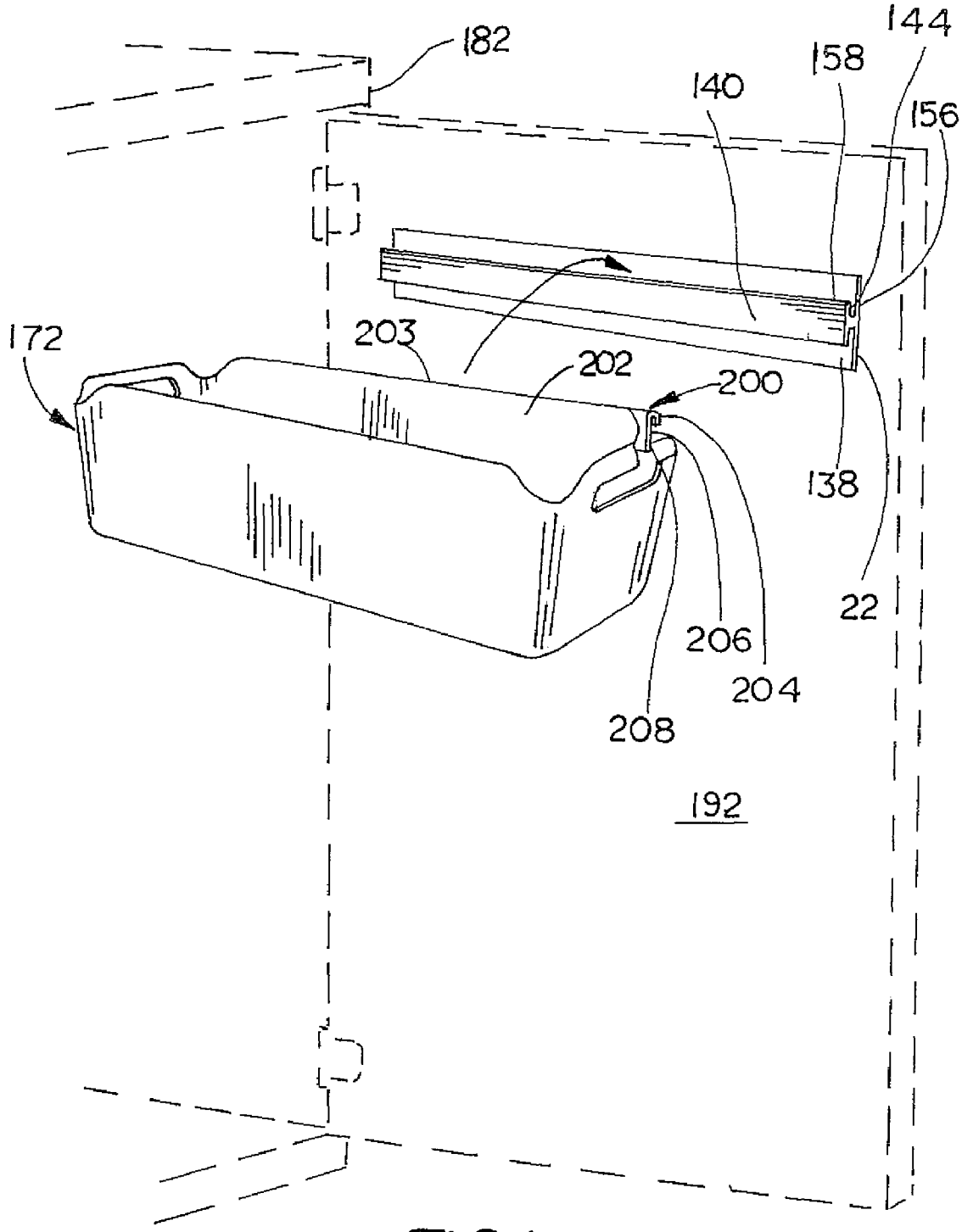
FIG. 13 shows one example of a basket assembly of a storage system installed within a cabinet via a track mounted in a vertical orientation.
Figure 15:
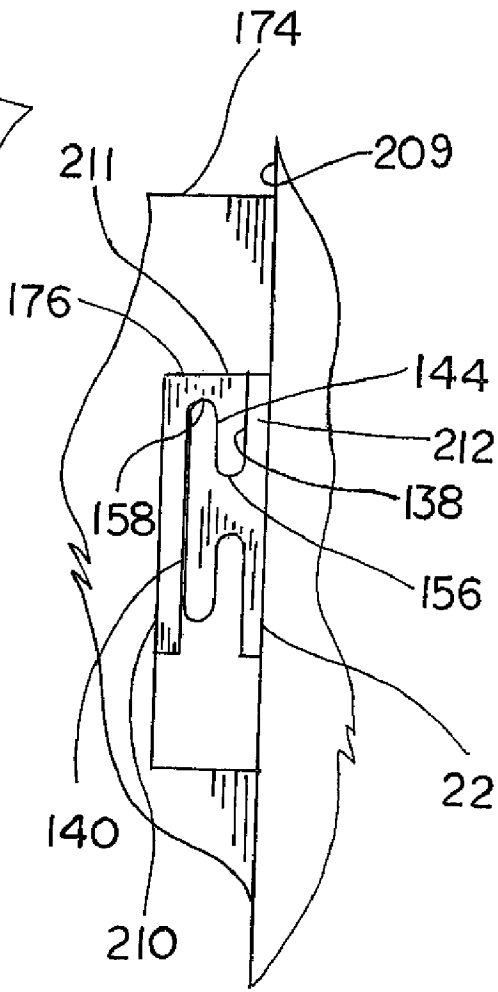
FIG. 15 shows the installed storage cabinet assembly of FIG. 14 in greater detail to depict the engagement and mounting of the track.
Figure 14:
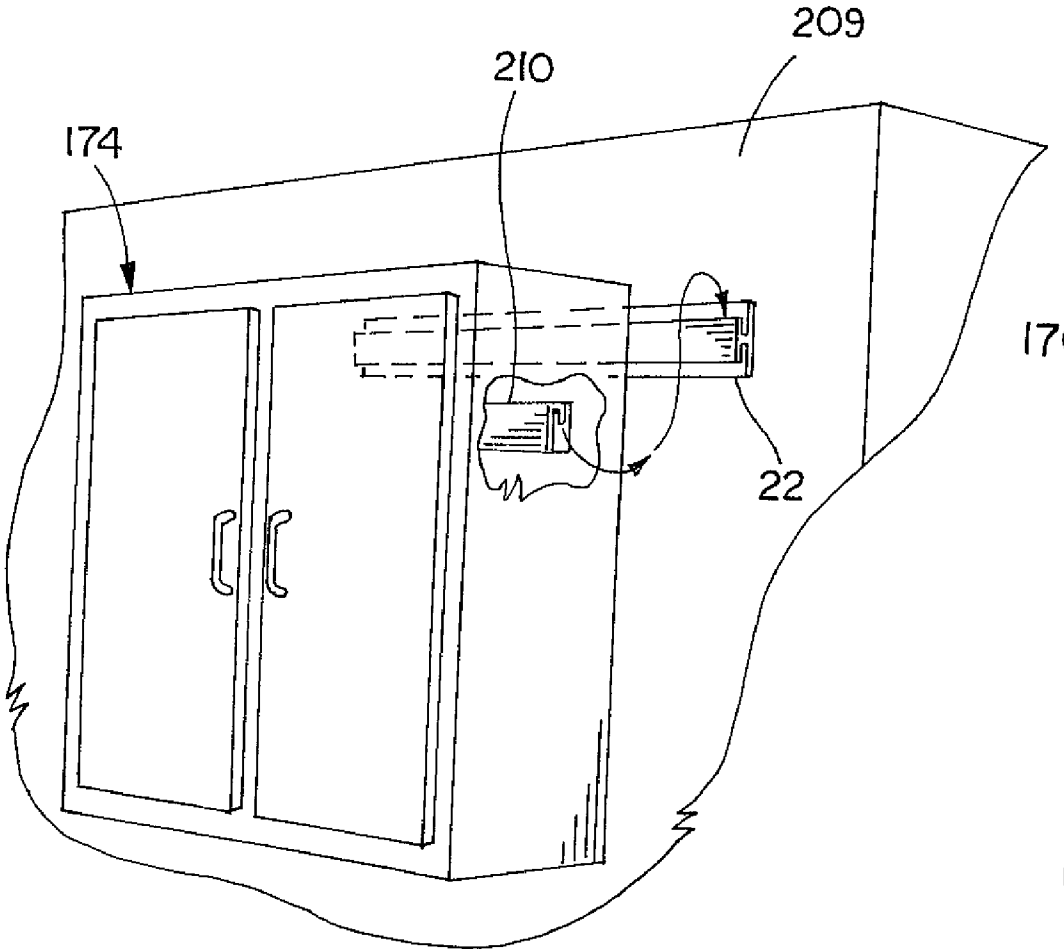
FIG. 14 shows one example of a storage cabinet assembly of a storage system installed via a track mounted in a vertical orientation.
Figure 16:
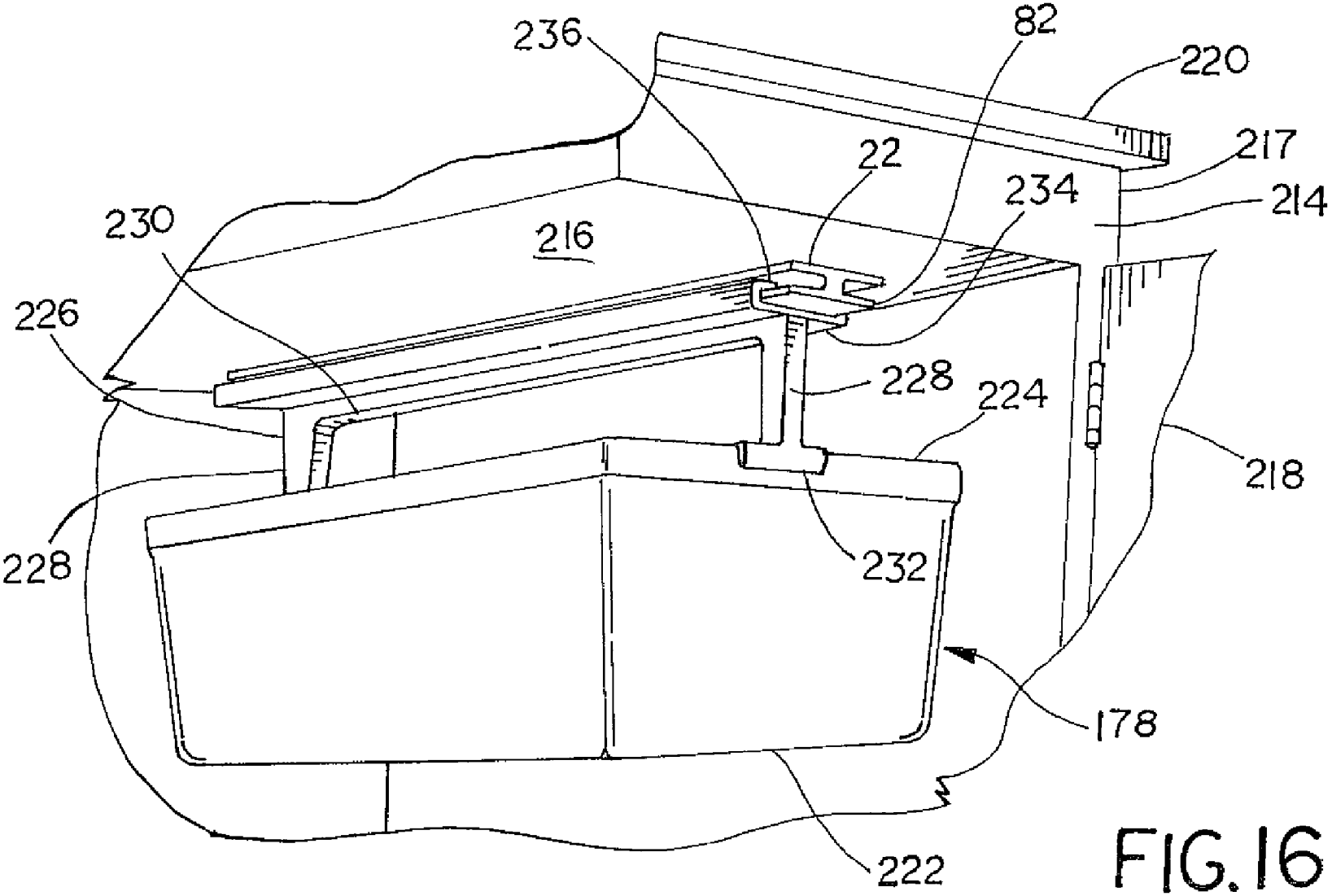
FIG. 16 shows one example of a storage container assembly of a storage system installed within a cabinet via a track mounted in an inverted orientation.
Figure 17:
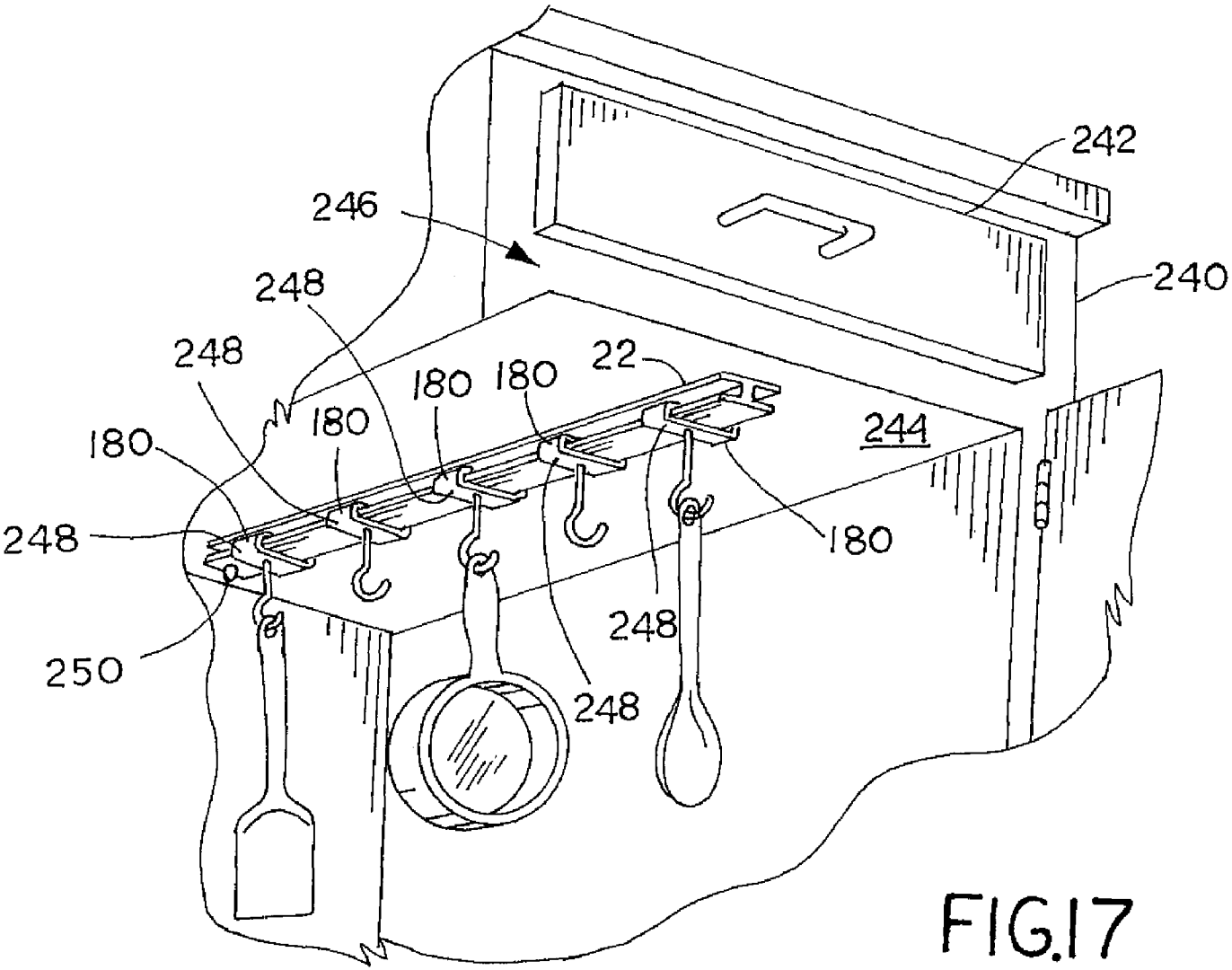
FIG. 17 shows one example of a storage rack assembly on a storage system installed within a cabinet via a track mounted in an inverted orientation.

Several exemplary storage systems are shown in FIGS. 12-17. In FIG. 12, an organizer rack assembly 170 is supported with the track 22 in an upright orientation. FIGS. 13 and 14 depict a basket 172 and a cabinet 174 suspended from vertical support surfaces upon which the track 22 is mounted in a vertical orientation. The engagement of the track 22 and a hook 176 of the cabinet 174 is shown in greater detail in FIG. 15. In FIGS. 16 and 17, the track 22 is disposed in the inverted orientation to allow different storage items to hang from the track 22, specifically a container 178 (FIG. 16) and hanger hooks 180 (FIG. 17). Further details regarding these exemplary storage systems and the orientation and configuration of the track 22 are provided below.

Turning now to the storage system shown in FIG. 12, the organizer rack assembly 170 is well-suited and configured for installation within a cabinet 182. The track 22 is then used as a sliding mechanism to allow the assembly 170 to move further into and/or out of the cabinet 182. In this example, the cabinet 182 includes a lateral shelf 184 that defines a horizontal support surface 186 upon which the track 22 is mounted. Other surfaces within the cabinet 182 may alternatively provide the support surface, including, for instance, a floor 188, a side wall 190, or a door 192. As shown, the track 22 is oriented upright such that the organizer rack assembly 170 slides above the support surface 186 of the cabinet shelf 184. To that end, and as described above, one or more of the surfaces 138, 140 of the track 22 bear the load of the organizer rack assembly 170, while one or more of the surfaces 156, 158 act as lateral guides or retainers. In this case, the surfaces 144 of the track 22 may also contain the organizer rack assembly 170 by limiting or preventing upward movement.

The organizer rack 170 may be similar in one or more respects to the storage rack assembly 90 of FIGS. 5-8. In this example, the organizer rack 170 has a molded platform 194 mounted above a runner 196. The runner 196 may, but need not, be constructed and configured like the runners 26 (FIG. 1) and 112 (FIG. 5) described above. For example, the runner 196 is an elongated strip bent into a C-shaped cross-sectional shape to engage the track 22 as shown. The runner 196 and other aspects and characteristics of the organizer rack 170 may vary considerably from that shown, as with the other storage assemblies and items described herein. The organizer rack 170 is further only one of a variety of types of storage assemblies, devices or items well-suited for use within the interior cabinet space above a floor or shelf in accordance with the disclosed storage systems. Other suitable examples include trays, drawers, and baskets, each of which may similarly engage the track 22 in the upright orientation shown.

FIG. 13 depicts an installation example in which the track 22 acts as a suspension rail for the basket 172. The track 22 is again installed within the interior space of the cabinet 182, but now is mounted to the door 192 of the cabinet 182. The basket 172 has a hook 200 secured to the exterior surface a side 202 configured to engage the track 22. In this example, the hook 200 is elongated, but need not extend the entire length of the side 202, e.g., the width of the basket 172, as shown. The hook 200 is positioned at or near a top edge 203 of the basket 172, which may facilitate engagement of the track 22. The shape, positioning, size and other characteristics of the hook 200 may vary considerably and still remain well-suited for engaging the track 22. For instance, the hook 200 need not be shaped as a strip bent into the shape shown. In this case, however, the hook 200 is bent to include a catch 204 and a flat or planar surface 206 to meet and match the surface 140 of the track 22. Other examples may have more than one hook to engage the track 22.

With the track 22 disposed in the vertical orientation, one or more of the surfaces 156, 158 of the track 22 may support the load of the basket 172, while one or more of the surfaces 138, 140, 144 may retain or guide the basket 172. The track 22 may also serve as a sliding rail, as described above, as the catch 204 and other portions of the hook 200 are open-ended. More specifically, the hook 200 has an open end 208 such that the basket 172 can progressively engage the track 22 by sliding onto and along the track 22 in the longitudinal (or lengthwise) direction. The sliding engagement is facilitated by the surfaces and configuration of the track 22, as described above, and the cooperative or complementary shape and surfaces of the hook 200. The sliding engagement may be helpful in, for example, an installation in which the basket 172 is suspended within the cabinet 182 on an interior wall (rather than on the door 192).

As shown in FIG. 13, the track 22 has a length roughly commensurate with the length (or width) of the basket 172. This may differ slightly from the examples described above, where the track 22 is considerably shorter than the storage assembly or item. More generally, the length of the track 22 may differ to any desired extent relative to the corresponding dimension of the basket 172 or other storage item suspended therefrom. Notwithstanding the foregoing, the track 22 is well suited for installations and systems involving limited space, i.e., where the track 22 is not considerably longer than the engaged storage assembly or items.

Turning now to FIGS. 14 and 15, the exemplary use of the track 22 in the installation of the cabinet 174 also involves the mounting of the track 22 in a vertical orientation on a wall 209 or other vertical surface. In this example, the hook 176 of the cabinet 174 engages the track 22 in a manner similar to the hook-based engagement shown and described above. More specifically, the hook 176 may include an elongated strip 210 a top edge 211 laterally and downward to form a catch 212 sized to match or complement the strip 22. As shown in FIG. 15, the catch 212 fits in a groove defined by the surfaces 138, 144 of the track 22.

In this example, the fit between the track groove and the hook 176 is tight to ensure a stable installation of the cabinet 174. The track 22 and the hook 176 are, in fact, shaped in complementary fashion. As best shown in FIG. 15, each of the surfaces 156, 158 of the track 22 engages complementary surfaces of the hook 176 to support the load of the cabinet 174, and each of the surfaces 138, 140, 144 stabilize the cabinet 174 via contact with the complementary surfaces of the hook 176. In alternative cases, the engagement of the hook 176 and the track 22 may include a press-fit arrangement. As a result, the hook 176 and/or the track 22 need not have a tacky, rubberized or other material or material layer affixed or applied thereto to discourage sliding or other relative movement. In that way, the track 22 remains well-suited for use in other installations in which sliding and movement are advantageous. Alternatively, such materials or layers may be selectively applied or introduced as desired.

With reference now to FIG. 16, the track 22 is mounted in the inverted orientation within a cabinet 214 on an overhead surface 216. The surface 216 may, but need not, correspond with an interior ceiling 217 of the cabinet 214. The ceiling 217 may be part of the frame of the cabinet 214, a part of a floor for a drawer assembly, and/or an underside of a countertop. More generally, the overhead surface 216 may be an interior or exterior surface, and need not form a ceiling as shown, but rather may be any surface from which a storage item can hang downward, such as a bottom surface of an overhead cabinet (i.e., an under-cabinet installation). In this cabinet-based example, the container 178 is suspended from the track 22 within the cabinet 214 in the space behind a door 218. Upon opening the door 218, access to items in the container 178 may be facilitated by the sliding engagement of the track 22 and the container 178. In other cases, access to the suspended storage item (and any contents thereof) may not be as much of an issue, as the overhead surface from which the storage item(s) is suspended need not be within a cabinet or other closely defined space. In this example, however, the container 178 is disposed beneath a countertop 220 such that access to articles stored in the container 178 may be significantly improved after sliding the container 178 out from under the countertop 220. As a result, the container 178 provides the functionality of a drawer without requiring an underlying surface, such as a cabinet shelf.

The container 178 includes an open-top box or receptacle 222 with an upper rim or edge 224 to which a handle 226 is attached. The handle 226 includes two upstanding posts 228 and a crossbeam 230 disposed in between the posts 228. The posts 228 may be secured to the rim 224 of the container 178 in any desired manner, and need not include a coupler or clip 232 as shown. The posts 228 and/or the crossbeam 230 are attached to a runner 234 shaped to engage the track 22. In this example, the runner 234 includes a strip 236 bent into a shape that engages the bar 82 such that the surfaces 144 (FIG. 10) bear the load of the container 178 and other surfaces of the bar 82, the stem 84, and/or the mounting base 130 (FIG. 10) retain the runner 234 as described above in connection with FIG. 10.

FIG. 17 depicts another installation example involving the interior space of a cabinet 240. In this case, the interior space is disposed beneath a drawer 242. The track 22 is mounted in the inverted orientation on an overhead surface 244 of a shelf or platform 246 on which the drawer 242 is mounted. As described above, the nature of the mounting surface 244 may vary considerably. In general, the inverted orientation allows the hanger hooks 180 and any items coupled thereto to hang downward from the surface 244. Each hanger hook 180 may engage the track 22 in a manner similar to that described above in connection with the container 178 (FIG. 16). To that end, each hanger hook 180 may include a runner 248 with a C-shaped cross-section. As a result, each runner 248 may engage the surfaces and components of the track 22 as described above in connection with the inverted orientation.

The hanger hooks 180 may be used in any desired configuration or arrangement. For example, the hanger hooks 180 need not be dedicated to respective items as shown, but rather multiple hanger hooks 180 may be used to hang a single item. The items may, of course, vary from the exemplary pot, spatula, and spoon shown. These and other items attached to the hooks 180 may be arranged and disposed within the cabinet 240. Storage systems may use a varying number of the hanger hooks S80, as the hooks 180 can be selectively slid onto the track 22. As the number increases, a projection or stop 250 may be included to prevent the hanger hooks 180 from disengaging the track 22. The stop 250 in this example extends downward from the bar 82, but may alternatively or additionally be positioned on the stem 84 and/or the base 130.

Notwithstanding the stop 250 of the example shown in FIG. 17, another aspect of the disclosed storage systems and devices depicted in FIGS. 12-17 involves the open-ended nature of the track 22. As also shown in FIGS. 9 and 1 0, one or both of the longitudinal ends of the track 22 are not capped or blocked. Storage assemblies or items accordingly may slide onto the track via one or both of the longitudinal ends. In some cases, such as the cabinet examples, this feature may greatly facilitate and simplify installation and use. The open end(s) of the track 22 also allow the storage assemblies and items to slide beyond the track 22. In this way, the track 22 supports sliding more extensive displacement or travel of the assemblies and items, which may facilitate access to a storage space in a drawer, cabinet, etc. In cases where one of the ends can benefit from having a stop, a projection such as the stop 250 may be removably or non-permanently affixed via adhesive, etc.

The hanger hooks 180 are exemplary in nature, as a variety of other hanger hook constructions are well suited for use with the track 22. For instance, various hanger hooks may be constructed for use in connection with the vertical orientation. In those cases, the hanger hooks need not have a C-shaped cross-section as shown in FIG. 17, but rather a shape similar to that shown in FIG. 15.

As described above, the disclosed storage systems and devices may include and utilize a common track. The versatility of the common track is based in part on the symmetry of an I-beam shape that presents a matching pair of grooves on lateral sides of a monorail. The symmetrical, double-groove, monorail arrangement simplifies and improves track engagement in a number of optional track orientations, thereby supporting a variety of different installations and storage assemblies and items.

Although certain systems, assemblies, devices, and methods have been described herein in accordance with the teachings of the present disclosure, the scope of coverage of this patent is not limited thereto On the contrary, this patent covers all embodiments of the teachings of the disclosure that fairly fall within the scope of permissible equivalents.

What is claimed is:

1. An organizer assembly system, comprising:

a track having a base and a bar coupled to, and spaced from, the base to form an I-beam having a longitudinal axis, the base being configured for attachment to a first mounting surface or a second mounting surface, and the bar being configured as a rail in a plurality of rail orientations of varying lengthwise rotation of the track about the longitudinal axis;

a first organizer item having a runner to engage the bar of the track in a first rail orientation of the plurality of rail orientations in which the track is attached to the first mounting surface and the runner rides upon a first surface of the bar such that the track supports the first organizer item relative to the first mounting surface; and a second organizer item having a hook to engage the bar of the track in a second rail orientation of the plurality of rail orientations in which the track is lengthwise rotated from the first rail orientation and attached to the second mounting surface such that the hook engages a second surface of the bar that supports the second organizer item to suspend the second organizer item along the second mounting surface.

2. The organizer assembly system of claim 1, wherein the first surface of the bar laterally guides the second organizer item in the second rail orientation, and wherein the second surface of the bar laterally guides the first organizer item in the first rail orientation.

3. The organizer assembly system of claim 1, wherein the first mounting surface is an interior horizontal cabinet surface, and the second mounting surface is an interior vertical cabinet surface.

4. The organizer assembly system of claim 1, wherein the track is symmetrical about the longitudinal axis,

5. The organizer assembly system of claim 1, wherein the first and second surfaces of the track are substantially flat.

6. The organizer assembly system of claim 1, wherein the track is mounted upon the first mounting surface such that the track supports the first organizer item above the first mounting surface in the first rail orientation.

7. The organizer assembly system of claim 1, wherein the track is mounted beneath the first mounting surface such that the first organizer item is suspended from the first mounting surface in the first rail orientation.

8. The organizer assembly system of claim 1, further comprising a third organizer item 1having a slide with a C-shaped cross-section to engage the bar in a third rail orientation of the plurality of rail orientations in which the track is lengthwise rotated from the first and second rail orientations such that the slide of the third organizer item rides upon the bar to suspend the third organizer from the mounting surface.

9. The organizer assembly system of claim 1, wherein the runner has a C-shaped cross-section.

10. An organizer assembly system, comprising:

a track having a base and a bar coupled to, and spaced from, the base to define a pair of grooves symmetrically disposed along a longitudinal axis of the track, the base being configured for attachment to a first mounting surface or a second mounting surface, and the bar being configured as a rail in a plurality of rail orientations of varying lengthwise rotation of the track about the longitudinal axis;

a first organizer item having a runner to engage the track in a first rail orientation of the plurality of rail orientations in which the track is attached to the first mounting surface and the runner is disposed within the pair of grooves; and a second organizer item having a hook to engage the track in a second rail orientation of the plurality of rail orientations in which the track is lengthwise rotated from the first rail orientation and attached to the second mounting surface such that the hook is disposed within one of the pair of grooves.

11. The organizer assembly system of claim 10, wherein the first mounting surface is an interior horizontal cabinet surface, and the second mounting surface is an interior vertical cabinet surface.

12. The organizer assembly system of claim 10, wherein the track is symmetrical about the longitudinal axis.

13. The organizer assembly system of claim 10, wherein the first and second surfaces of the track are substantially flat.

14. The organizer assembly system of claim 10, wherein the track is mounted upon the first mounting surface such that the track supports the first organizer item above the first mounting surface in the first rail orientation.

15. The organizer assembly system of claim 10, wherein the track is mounted beneath the first mounting surface such that the first organizer item is suspended from the first mounting surface in the first rail orientation.

16. The organizer assembly system of claim 10, further comprising a third organizer item having a slide with a C-shaped cross-section to engage the bar in a third rail orientation of the plurality of rail orientations in which the track is lengthwise rotated from the first and second rail orientations such that the slide of the third organizer item rides upon the bar to suspend the third organizer from the mounting surface.

17. The organizer assembly system of claim 10, wherein the runner has a C-shaped cross-section.

18. The organizer assembly system of claim 10, wherein the track has an I-beam shape.

* * * * *

UNITED STATES PATENT AND TRADEMARK OFFICE

CERTIFICATE OF CORRECTION

PATENT NO. : 7,992,728 B2
APPLICATION NO. : 12/183821
DATED : August 9, 2011
INVENTOR(S) : Burgess et al.

It is certified that error appears in the above-identified patent and that said Letters Patent is hereby corrected as shown below:

In column 14, claim 8, line 10, please delete "1".

Signed and Sealed this
Fifteenth Day of November, 2011

David J. Kappos

David J. Kappos
*Director of the United States Patent and Trademark Office*